US005461798A

United States Patent [19]

Ribeiro

[11] Patent Number: 5,461,798

[45] Date of Patent: Oct. 31, 1995

[54] STAIR STRINGER LAYOUT JIG

[76] Inventor: Faustino A. Ribeiro, 795 Baldwin St., Waterbury, Conn. 06706

[21] Appl. No.: 336,480

[22] Filed: Nov. 9, 1994

[51] Int. Cl.[6] ..... B43L 7/12; B43L 13/02

[52] U.S. Cl. ..... 33/562; 33/415; 33/418; 33/526

[58] Field of Search ..... 33/562, 415, 418, 33/419, 423, 430, 438, 441, 443, 446, 452, 464, 474, 526, 534

[56] References Cited

U.S. PATENT DOCUMENTS

| | | | |
|---|---|---|---|
| 136,653 | 3/1873 | Hyman . | |
| 168,656 | 10/1875 | McInnes . | |
| 327,283 | 9/1885 | Levy . | |
| 796,030 | 8/1905 | Baumgartner . | |
| 831,870 | 9/1906 | Huyett | 33/562 |
| 935,067 | 9/1909 | Taylor . | |
| 1,995,658 | 3/1935 | Thompson | 33/423 |
| 2,087,102 | 7/1937 | Chandler | 33/438 |
| 3,250,014 | 5/1966 | Watson . | |
| 3,478,434 | 11/1969 | Catalano | 33/418 |
| 4,580,352 | 4/1986 | Wilson | 33/563 |

FOREIGN PATENT DOCUMENTS

| | | | |
|---|---|---|---|
| 671388 | 2/1939 | Germany | 33/443 |

*Primary Examiner*—Christopher W. Fulton
*Attorney, Agent, or Firm*—William C. Crutcher

[57] ABSTRACT

A stair stringer layout jig used on a pair of stringers disposed side-by-side adjacent one another comprises a longitudinal base lying along and between the stringers, with spacers for uniformly spacing the stringer sides. A transverse member with two clamps is connected to the base to squeeze the stringers together. A pair of carpenter's squares are disposed symmetrically in mirror relationship on opposite sides of the stringers so as to allow the legs of the squares to pivot. A vernier adjustment serves to simultaneously pivot the carpenter's squares in opposite directions about their pivot points, so as to lay out stair riser and stair tread locations which may be simultaneously and identically varied in mirror relationship on both of said stringers.

5 Claims, 2 Drawing Sheets

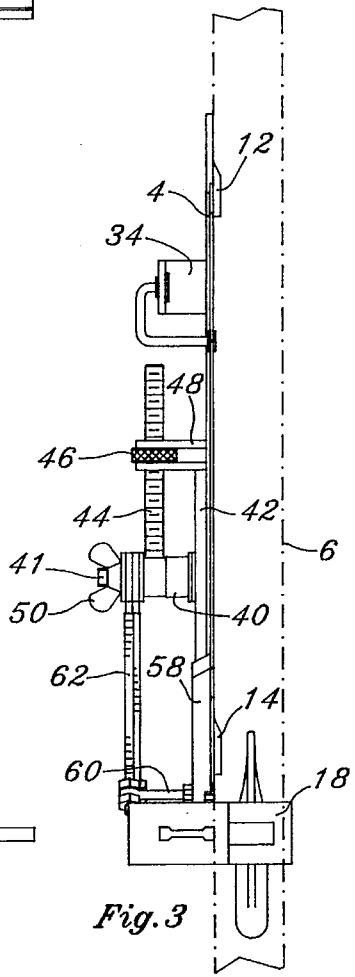
Fig. 3
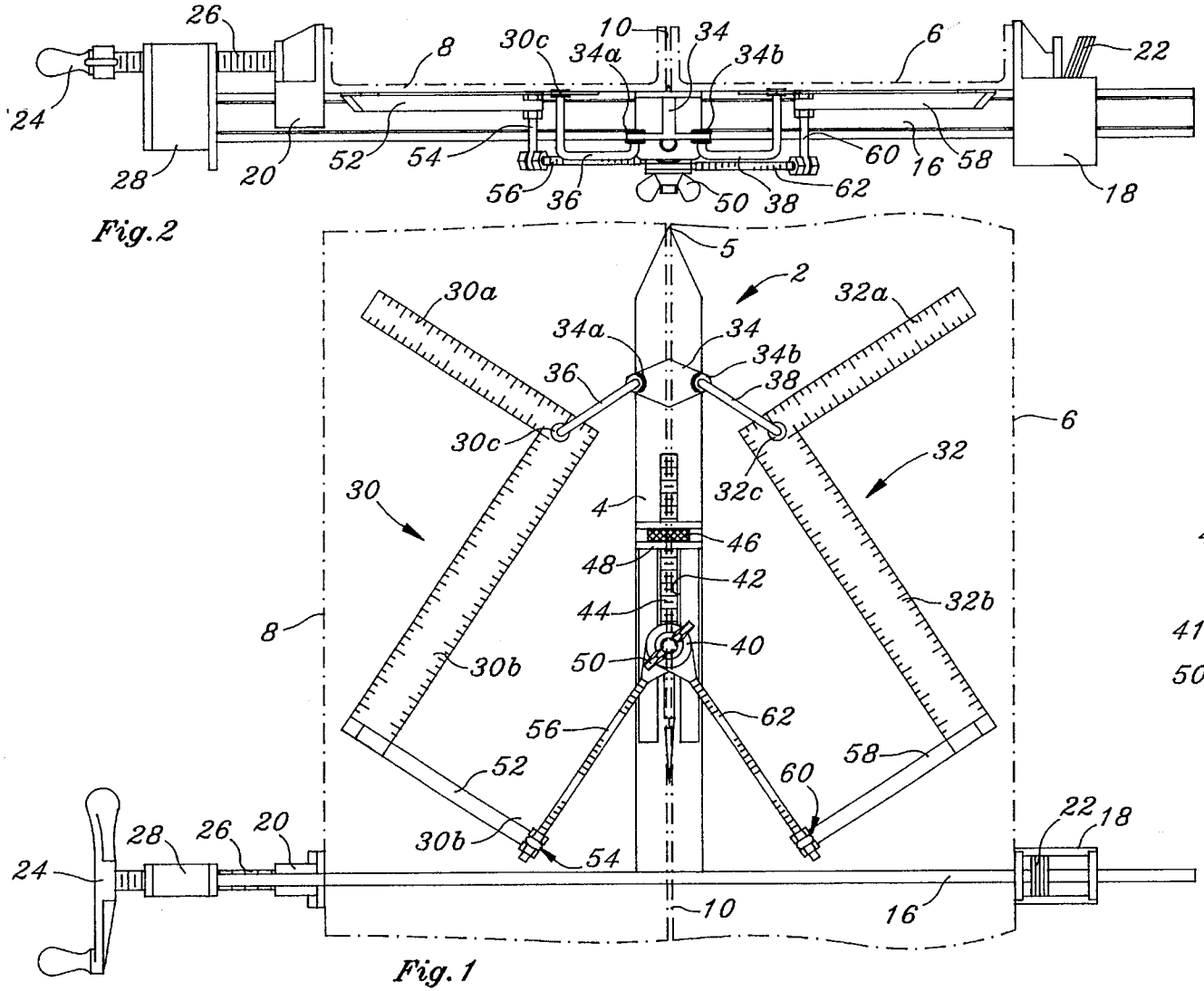
Fig. 2
Fig. 1

STAIR STRINGER LAYOUT JIG

BACKGROUND OF THE INVENTION

This invention relates generally to a new and improved tool or jig designed to lay out the location of treads and risers on the stringers to be used in constructing a stairway. More particularly, the invention relates to an improved stair stringer layout jig in which the tread and riser dimensions may be simultaneously adjusted on both stringers so as to enable uniform tread and riser dimensions over the entire stairway.

The technique of laying out treads and risers on a stair stringer is well known to those skilled in the art. Jigs or tools have been designed to assist in this procedure from the earliest days, as illustrated by exemplary U.S. Pat. No. 796,030 issued to Baumgartner on Aug. 1, 1905, wherein a straight edge is positioned along a stringer, and a carpenter's square is pivoted about a point located within the intersection of its two legs to change the pitch of the stairs, i.e., to change the relative proportions of the length of tread and riser. The jig is moved longitudinally along the stringer to each new tread and riser location and lines scribed on the stringer, which are then either used to cut the stringer or to attach supports for the treads and risers.

A stair layout tool suitable for a metal channel-shaped stringer is shown in U.S. Pat. No. 3,478,434 issued to Catalano on Nov. 18, 1969. In either of the aforesaid tools, the carpenter's square may be pivoted in order to change the pitch (relative lengths of treads and risers) so as to provide an integral number of equally dimensioned steps within the available space. However, when scribing one tread and riser at a time on one stringer, there are minute accumulated errors. In attempting to duplicate the layout on the opposite stringer, variations can occur between the two stringers which are undesirable.

U.S. Pat. No. 3,250,014 issued May 10, 1966 to Watson describes a layout jig for the full length of a stair stringer, enabling all tread and riser dimensions to be simultaneously adjusted for one stringer. However the apparatus is very complicated, has a large number of parts and is able to do only one stringer at a time.

It would be desirable to provide a simplified stringer layout jig, which would insure duplication of results on the two stairway stringers. It would also be desirable to provide an improved stringer layout jig in which the tread and riser dimensions could be adjusted simultaneously and identically on two mating stringers at once.

Accordingly, one object of the present invention is to provide an improved jig for laying out tread and riser locations on a stair stringer.

Another object of the invention is to provide an improved jig for laying out two mating stair stringers simultaneously.

Still another object of the invention is to provide an improved stair stringer layout jig in which tread and riser dimensions may be adjusted on two stringers simultaneously and identically.

SUMMARY OF THE INVENTION

Briefly stated, the invention is practiced by providing a stair stringer layout jig adapted to receive a pair of stringers disposed side-by-side adjacent one another. The jig comprises a longitudinal base having means for locating the base positions along and between the stringers, and means for clamping the base and stringers together. Preferably, the locating means comprises spacers for uniformly spacing the stringer sides. Preferably the clamping means comprises a transverse member and two clamps which may slide along the transverse member and squeeze the stringers and locating means together. A pair of carpenter's squares are disposed symmetrically in mirror relationship on opposite sides of the stringers, and a pair of support members are attached between the base and respective squares so as to allow the legs of the squares to pivot. Common adjusting means are disposed on the base which are connected to the squares and adapted to simultaneously pivot the carpenter's squares in opposite directions about their pivot points, whereby the legs may be used to lay out stair riser and stair tread locations which may be simultaneously and identically varied in mirror relationship on both of said stringers.

DRAWING

The invention, both as to organization and method of practice, together with further objects and advantages thereof, will best be understood by reference to the following description, taken in connection with the accompanying drawings, in which:

FIG. 1 is a plan view of a layout jig positioned on two adjacent stair stringers, portions of which are indicated in phantom, FIG. 2 is an end elevational view (inverted) of the jig shown in FIG. 1, FIG. 3 is a side elevational view of the jig shown in FIG. 1, FIG. 4 is a plan view of the jig shown in FIG. 1, illustrating pivoting of the carpenter's squares, and FIG. 5 is a plan view illustrating the jig in two different longitudinal positions along the stringers.

DESCRIPTION OF THE PREFERRED EMBODIMENT

Figure 4:
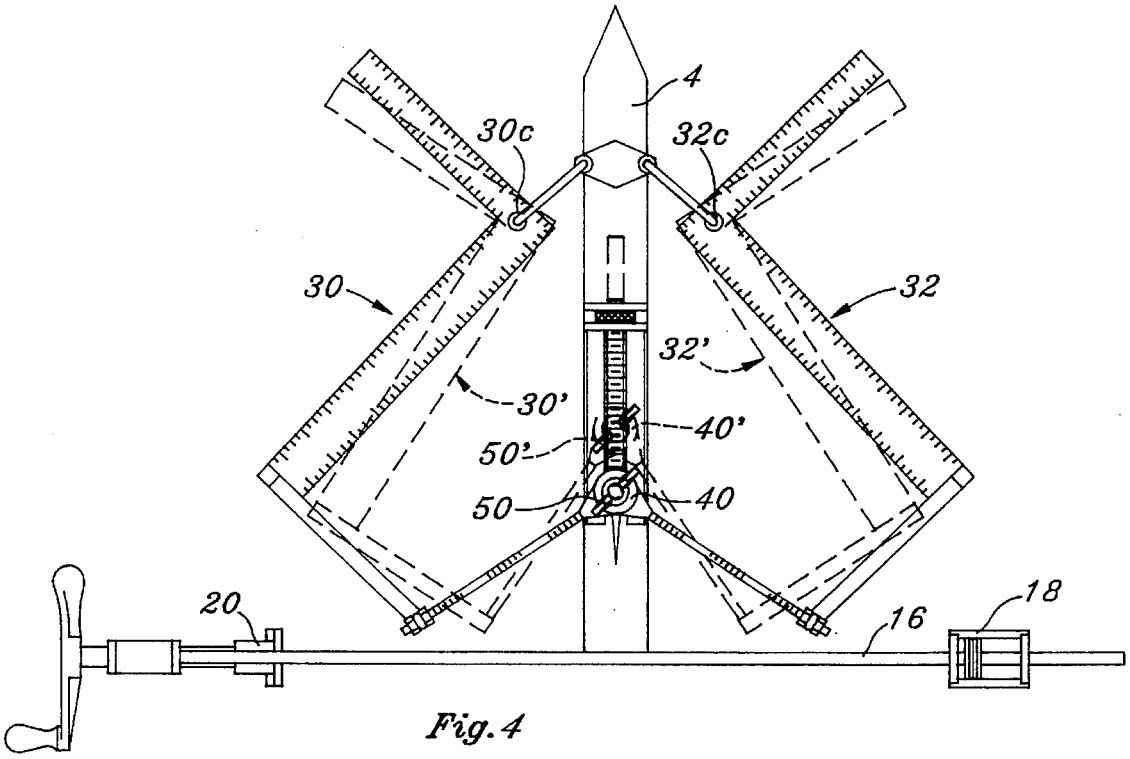

Referring now to FIG. 1 of the drawing, my improved jig, shown generally as 2 comprises a base 4 comprising a flat longitudinal metal member adapted to lie parallel to the sides of two adjacent metal stringers 6, 8, portions of which are shown in phantom lines in FIG. 1–3. The stringers are preferably metal channels placed together side by side, and uniformly spaced by a gap 10. Base member 4 may be provided with a point 5 on its centerline to indicate when it is properly centered on gap 10. Base member 4 includes a pair of depending small spacer lips 12, 14 seen in FIG. 3 which are used to longitudinally locate base member 4. The spacer lips 12, 14 uniformly space the stringers 6, 8 from one another so as to establish the gap 10.

Means for clamping the base member and stringers together include a transverse member 16 fixed perpendicular to base member 4 and a pair of spaced clamping blocks 18, 20 arranged to slide on the transverse member. A set of inclined plates 22 with openings (not shown) receiving transverse member 16 permit locking clamp 18 on the transverse member. On the opposite side, a crank handle 24, threaded member 26 and collar 28 cooperate in a well known arrangement to cause clamping block 20 to squeeze the stringers together against clamp 18 when the crank handle 24 is turned.

A pair of carpenter's squares 30, 32 are symmetrically positioned in mirror relationship on opposite sides of base member 4 above the stringers. Square 30 includes a leg **30*a* and a leg 30*b*** intersecting therewith and having a pivot hole 30*c* within the intersection. Similarly square 32 has a leg 32*a*, a leg 32*b*, and a pivot hole 32*c* within the intersection. A T support 34 having its base attached to jig base 4 includes a pair of rigid welded connections 34*a*, 34*b* to extension rods 36, 38. The free ends of the extension rods 36, 38 extend downward into holes 30*c*, 32*c* respectively, and serve as pivotable bearings for carpenter squares 30, 32 respectively.

The width of the legs 30*a*, 32*a* used to layout the risers is preferably the desired dimension for "kickback" space on the riser, i.e., the toe room beneath the end of the tread. The width of legs 30*b*, 32*b* used to layout the treads is preferably the proper thickness for a tread.

The T support 34 on the jig base 4 and the extension rods 36, 38 together comprise a pair of support members attached between the jig base 4 and the respective intersections of the squares which allow the legs of the squares to pivot around holes 30*c*, 32*c* in their respective intersections.

In order to simultaneously pivot the carpenter squares in opposite directions about their respective intersections, a common adjusting mechanism is located on the jig base 4 and is connected to both squares through a pair of linkage extension assemblies. A longitudinally movable pivot block 40 is arranged to slide in a track 42 and is attached to a threaded member 44. A threaded vernier wheel 46 supported between brackets 48 attached to base 4 turn the threaded member to cause block 40 to move longitudinally along the base when vernier wheel 46 is rotated. Block 40 includes a thumb screw 50 which may be used to clamp the block 40 in track 42 and also to clamp the pair of extension attached linkage assemblies in place.

Each one of the pair of linkage extension assemblies is connected between one leg of a square and is pivotably connected to the block 40. One such linkage extension assembly comprises an extension 52 rigidly attached to leg 30*b*, a vertical pin 54 with a threaded upper end attached to member 52 (see FIG. 3), and a threaded linkage member 56 connected between the upper end of pin 54 and a post 41 on block 40.

On the other side, an identical linkage extension assembly comprises rigid member 58, vertical pin 60 and threaded linkage member 62. Threaded linkage members 56, 62 are pivotable about post 41 on block 40 and may be clamped by thumb screw 50 to prevent pivoting movement on blocks 40 once they are in position. This will also prevent further longitudinal movement of block 40 in track 42 and lock the vernier wheel 46 in place against accidental turning.

OPERATION

Referring first to FIG. 4 of the drawing, the operation of the adjusting means will be described. The solid lines and reference numbers are as previously described in connection with FIGS. 1–3. The dashed lines and reference numbers with prime mark superscript indicate the position of the members after adjustment has been made to set the pitch, i.e., ratio between riser and tread length. Thumb screw 50 is loosened and vernier wheel 46 is rotated. This causes pivot block 40 to slide longitudinally along base member 4 to its new position indicated at 40'. Movement of the pivot block constrains the two pairs of linkage extension assemblies to move with it. This causes carpenter squares 30, 32 to pivot in opposite rotational directions around points 30*c*, 32*c* as indicated in the drawing. Thumb screw 50' is then tightened.

Figure 5:
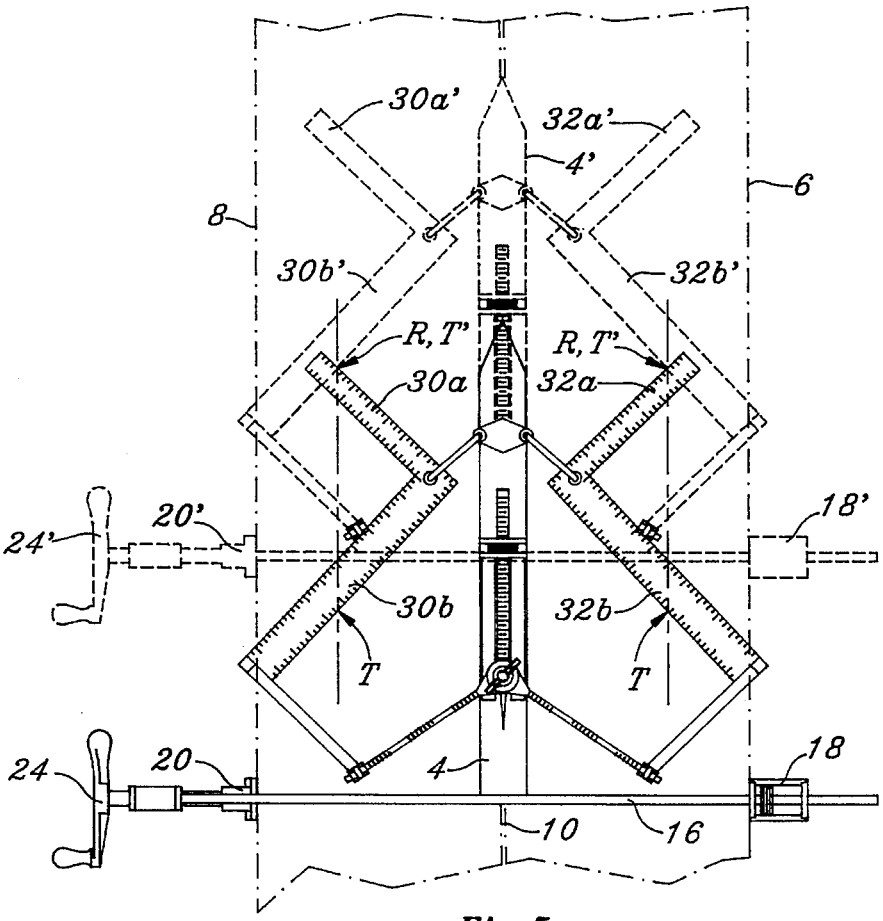

Reference to FIG. 5 of the drawing illustrates the operation of the locating means and clamping means. The same drawing conventions noted above are followed in FIG. 5. As the operation begins, the jig is clamped in place by clamp members 18, 20. The spacer lips 12, 14 (not seen) establish the gap 10 between stringers 6, 8 and hold the base member 4 disposed along and between the stringers. Supposing that a layout is desired on stringers 6, 8 of stairs having a tread length T and a riser length R. The pitch is set as described in FIG. 4 above so that the points T (measured along legs 30*b*, 32*b* of the carpenter's square) and the points R (measured along legs 30*a*, 32*a* of the carpenter's square) are established and marked on the two stringers, it being understood that the hypotenuse passing through the respective points R and T must be parallel to the sides of the stringers.

The tread and riser are marked on each stringer by scribing along both of the edges of the carpenter's squares. The finish dimension is scribed from R to the apex of the carpenter's square and from there to point T, i.e., on the side toward gap 10. The offset dimensions are scribed along the opposite sides of the legs of the carpenter's square, i.e., on the side of the square toward the outside stringer edges. The width of legs 30*a*, 32*a* is such as to establish the proper "kickback" dimension on the riser. The width of legs 30*b*, 32*b* are such as to establish the proper thickness of the concrete tread.

Next the clamp members 18, 20 are loosened by turning the hand crank 24, and the layout jig is slid longitudinally until points T coincide with the previous location of points R as indicated by the jig position in dashed lines. The clamps are retightened with hand crank 24' at the locations indicated at 18', 20' and the procedure is repeated over and over until the complete stringer layout has been accomplished.

While there has been described herein what is considered to be the preferred embodiment of the invention, other modifications will occur to those skilled in the art, and it is desired to secure in the appended claims all such modifications as fall within the true spirit and scope of the invention.

I claim:

1. A stair stringer layout jig adapted to receive a pair of stair stringers disposed side-by-side adjacent one another, said jig comprising:

a jig base having means for locating said base and between said stringers, means for clamping said base and said stringers together, a pair of carpenter's squares, each having two legs joined at an intersection, each of said squares disposed symmetrically in mirror relationship with respect to the other square, and disposed on opposite sides of said base above one of said stringers, a pair of support members attached between said base and respective intersections of said squares and arranged to allow the legs of the squares to pivot about their respective intersections, and common adjusting means disposed on said base and connected to said squares, and adapted to simultaneously pivot said carpenter squares in opposite directions about their respective intersections, whereby said legs may be used to lay out stair riser and stair tread locations, which may be simultaneously and identically varied in mirror relationship on both of said stringers.

2. The combination according to claim 1, wherein said jig base comprises a longitudinal member and wherein said locating means includes at least one spacer lip projecting from said longitudinal member and establishing a uniform space between the sides of said stringers.

3. The combination according to claim 2, wherein said clamping means comprises a transverse member fixed perpendicular to said jig base, and first and second clamp members disposed on said transverse member and arranged to selectively squeeze said stringers together and hold the jig base located along and between stringers.

4. The combination according to claim 1, wherein said common adjusting means includes a pair of linkage extension assemblies each one of said pair being connected to one leg of one of said carpenter squares, a longitudinally movable pivot block disposed on said jig base, said pivot block pivotably connected to each of said linkage extension assemblies, and means for adjusting the longitudinal position of said block.

5. The combination according to claim 4, wherein said pivot block is adapted to selectively clamp said linkage extension assemblies, and wherein said means for adjusting the longitudinal position of said pivot block comprises a threaded member with a vernier wheel.

* * * * *